US005325114A

United States Patent [19]

Fogle et al.

[11] Patent Number: 5,325,114

[45] Date of Patent: Jun. 28, 1994

[54] THERMAL PRINTING POSTAGE METER SYSTEM

[75] Inventors: Ronald L. Fogle, Springboro; John D. Mistyurik, Troy; Lorraine T. Porter, Dayton; Larry D. Strausburg, Waynesville, all of Ohio

[73] Assignee: Pitney Bowes Inc., Stamford, Conn.

[21] Appl. No.: 950,341

[22] Filed: Sep. 24, 1992

[51] Int. Cl.[5] ..... B41J 2/315; B41J 15/04

[52] U.S. Cl. ..... 346/76 PH; 400/120; 101/76; 101/91

[58] Field of Search ..... 346/76 PH; 400/120; 101/76, 91

[56] References Cited

U.S. PATENT DOCUMENTS 4,605,937 8/1986 Dolan et al. ..... 346/76 PH
4,746,234 5/1988 Harry ..... 400/120
4,938,129 7/1990 Miciukiewicz ..... 101/76

*Primary Examiner*—Benjamin R. Fuller
*Assistant Examiner*—Huan Tran
*Attorney, Agent, or Firm*—Charles G. Parks, Jr.; Melvin J. Scolnick

[57] ABSTRACT

The thermal printing postage meter includes a base supporting a registration wall and a deck, and a thermal print head mounted to the registration wall above a portion of the deck to define a print station. A position sensing assembly is provided for sensing the presence of the envelope's leading edge in the print station and informing a microcontroller. A thermal tape cassette is mounted to the registration wall such that a portion of the thermal ribbon passing below the thermal print head. A platen roller assembly and position assembly are responsive to instruction from the microcontroller for causing the platen roller to assume either a position biasing the envelope against the thermal ribbon and thermal print head or a retracted position. An ejection roller assembly having position assembly is responsive to instruction from the microcontroller for causing the ejection roller to assume either a retracted position or a position biasing the ejection roller against the envelope and an ejection plate. A motor which is responsive to the microcontroller causes the platen roller or the ejection roller to rotate. The microcontroller is programmed such that in response to activation of the position sensing means by the envelope, the microcontroller causes the platen roller assembly to bias the envelope and to initiate print sequence instruction to the print head while synchronously causing the drive means to cause the platen roller to rotate at a first speed. Upon completion of the print sequence, the microcontroller causes the platen roller to assume a retracted position and the ejection roller assembly to assume a biasing position and causing the ejection roller to rotate at a second speed for envelope ejection.

2 Claims, 7 Drawing Sheets

THERMAL PRINTING POSTAGE METER SYSTEM

BACKGROUND OF THE INVENTION

The present invention relates to thermal printing postage meter.

It is an object of a conventional printing press type postage meters to print a postage indicia on a present envelope characterized by producing a postage indicia of consistent print contrast across the printed indicia. Additionally, it is an objective of a conventional printing press type postage meter to obtain suitable print quality in the specified printing area for envelope of varying paper grades (i.e., smoothness), porosity and envelope contour in the printing area.

Of particular note is the effect of the envelope contour in the printing area on print quality. It is a requirement, for example, by the United States Postal Service, that the postage indicia be printed in the upper right corner of the envelope. The contents of a particular envelope can cause this area to assume a variety of contour characteristic due in large part to the thickness of the contents and the particular shape of the contents.

Conventional thermal printers have required a relatively flat surface in the print area in order to insure adequate print quality. Also, sufficient time must be allowed for ink transfer which is a function of the smoothness and porosity of the printing media. Hence, the difficulty in applying thermal printing technics to postage metering mailing machine and like applications. That is, in order to obtain suitable print quality, the conventional thermal printing postage meter requires that the envelope characteristic be within a narrow range. As a result conventional thermal printing postage meters have not been able to adequately provide a printed postage indicia on an envelope having the requisite print quality over a preferred range of envelope paper smoothness, porosity and contours at desired speeds suitable for board postage metering mail applications.

SUMMARY OF THE INVENTION

It is an object of the present invention to present a postage meter printing apparatus utilizing thermal printing technics having a suitable configuration to print an improved postage indicia of consistent print contrast across the printed indicia.

It is a further objective of the present invention to present a postage meter printing apparatus utilizing thermal printing having the capability of printing a consistent contrast indicia for a range of envelopes of varying paper grades and porosities.

It is a still further objective of the present invention to present a postage meter printing apparatus utilizing thermal printing technics having the capability of printing a consistent contrast indicia on envelopes having within a range of envelope contours in the printing area.

The thermal postage meter is comprised of a number of system modules. Upon the placement of an envelope on the deck of the thermal printer by an operator, the envelope is cause to encounter a position sensing assembly which includes an envelope stop arrangement. The envelope stop arrangement prevents the envelope from being longitudinally mis-positioned. Upon proper positioning of the envelope on the deck, the position sensing assembly senses the presence of the envelope and inform a microcontroller to first duck the position sensing assembly out of the way, inclusive of the stop assembly, and initiate the print sequence. Upon initiation of the print sequence, a platen roller assembly is repositioned to bias the print area of the envelope into contact with the print ribbon of a ribbon cassette. The thermal print head of the postage meter is positioned to also serve as a backing to the print ribbon. The microcontroller issues commands to the motor controller to cause a motor to then drives the platen roller. Rotation of the platen roller causes the envelope and cassette print ribbon to simultaneously traverse the print head while concurrently enabling the thermal print head. Following completion of the print cycle, the microcontroller causes the platen roller to be ducked below the deck and a pressure roller to be engaged for ejection of the envelope.

DETAILED DESCRIPTION OF THE PREFERRED EMBODIMENT

Figure 1:
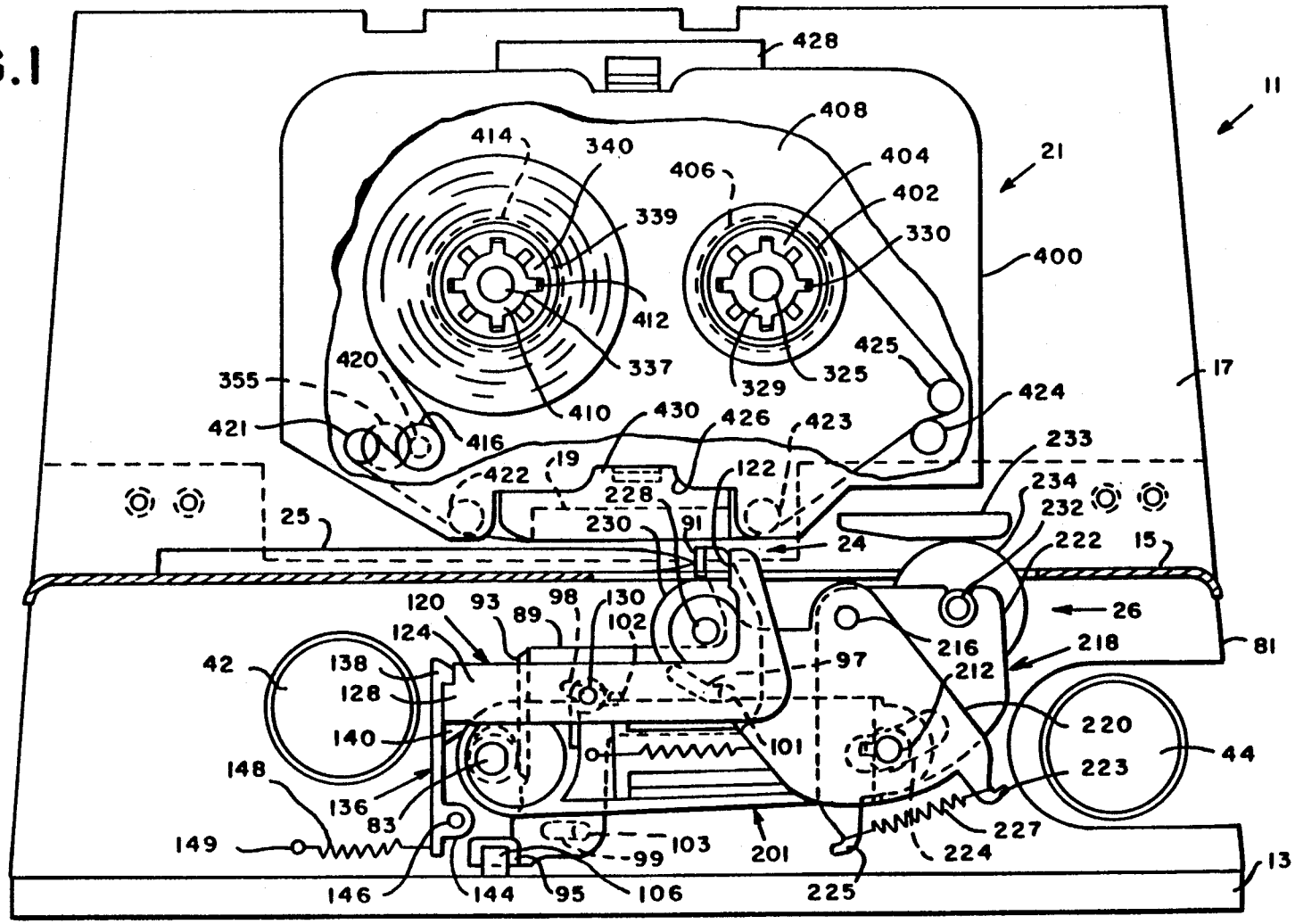
FIG. 1 is a partly section frontal view of a thermal postage meter and ribbon cassette in accordance with the present invention.

Referring to FIG. 1, a thermal postage meter, generally indicated as 11, includes a base 13 which supports a deck 15. The base 13 supports a registration wall 17, by any conventional means, to extend vertically upward from the deck. A thermal print head 19 is fixably mounted, by any conventional means, to the registration wall 17. The registration wall 17 has mounted thereto a thermal ribbon cassette 21. Mounted in the base 13 is a position sensing arrangement, generally indicated as 24, for sensing the position of an envelope 25 positioned on the deck 15 such that a leading portion of the envelope 25 is aligned to a platen roller assembly, generally indicated as 26.

Figure 2:
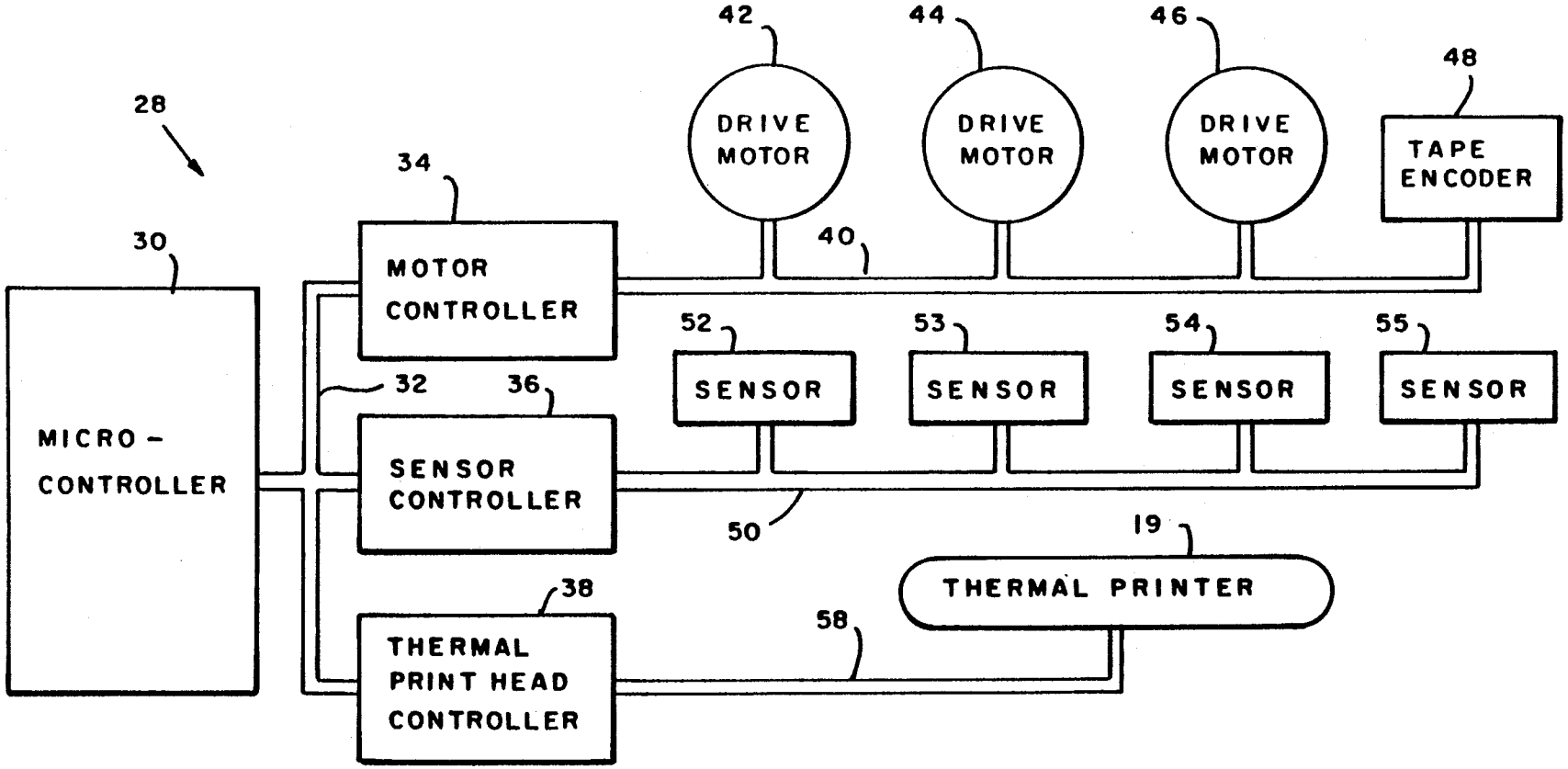
FIG. 2 is a schematic of a microcontroller in accordance with the present invention.

Referring to FIGS. 1 and 2, the thermal printing meter is under the influence of a system microcontroller, generally indicated as 28. The microcontroller system 28 is comprised of a programmable microcontroller 30 of any suitable conventional design, which is in bus 32 communication with a suitable motor controller 34, sensor controller 36, and thermal print head controller 38. The motor controller 34, sensor controller 36 and thermal print head controller 38 may be of any suitable conventional design. The motor controller 34 is in motor bus 40 communication with a plurality of drive motors 42, 44 and 46. The motor control bus 40 also communicates the motor controller 34 to a tape encoder 48. The sensor controller 36 is in sensor bus 50 communication with a plurality of sensors 52 to 55 and the thermal printer controller 38 is in print head bus 58 communication with the thermal print head 19.

Referring to FIGS. 3, 4, and 6A and 6B, the position sensing assembly 24 is comprised of a U-shaped support bracket 75 mounted to the base 13. The U-shaped support bracket 75 has a bracket forward wall 77 and a rear wall 79. Preferably, the bracket 75 is mounted to a base support wall 81 by any conventional means. It is noted that in the subsequent description, certain specific elements are presented as part of more than one assembly.

A shaft 83 is rotatively mounted to extend between the bracket walls 77 and 79 by any conventional means such as by a bearing assembly. A drive gear 85 is fixably mounted to the shaft 83 at one end. The motor 42 has a output gear 87 which is in constant mesh with the drive gear 85 for causing the shaft 83 to rotate under the influence of the motor 42. A position lever 89 which includes a envelope facing surface 91, camming surface 93, and sensor tab 95, and further includes slots 97, 98 and 99, is slidably mounted on hubs 101, 102 and 103 formed on the rear wall 79 of the bracket 75. The position lever 89 is mounted to the rear wall 79 such that the hubs 101, 102 and 103 ride within the respective slots 97, 98 and 99. A cam 105 is eccentrically mounted to the shaft 83 such that the camming periphery of the cam 105 is opposite the camming surface 93 of the position lever 89. A spring 107 is detachably mounted to the position lever at one end and to a formed tab 109 in the rear wall 79 at the other end. The spring biases the position lever 89 such that the camming surface 93 is biased against the cam surface of cam 105.

Referring to FIGS. 3, 4, and 7A and 7B, mounted to the forward bracket wall 77 is an envelope stop lever 120 which includes an envelope facing surface 122, channeled main section 124, a collared tab 126 mounted within the channel section 124, a cam follower surface 127 and an interlock tab 128. The stop lever 120 is pivotally mounted on a hub 130 which is formed in the forward bracket wall 77. A spring 132 which has one end attachably mounted to a tab 134 formed on the rearward bracket wall 77 and the other end attachably mounted to the collared tab 126 biases the camming surface 127 against the cam 135. A locking lever 136 which includes a locking tab 138 and 140 for securing the locking tab 128 of the envelope stop lever 120 between the locking tabs 138 and 140 of the locking lever 136. The locking lever 136 also includes a camming surface 142 opposite the cam 135 and a formed support ring 144 which is pivotally mounted to a tab 146 formed in the forward bracket wall 77. A spring 148 which is detachably mounted at one end to a tab 149 and at its other end to the envelope locking lever 136 is mounted for biasing the locking lever 136 in the direction of the cam 135.

Figure 3:
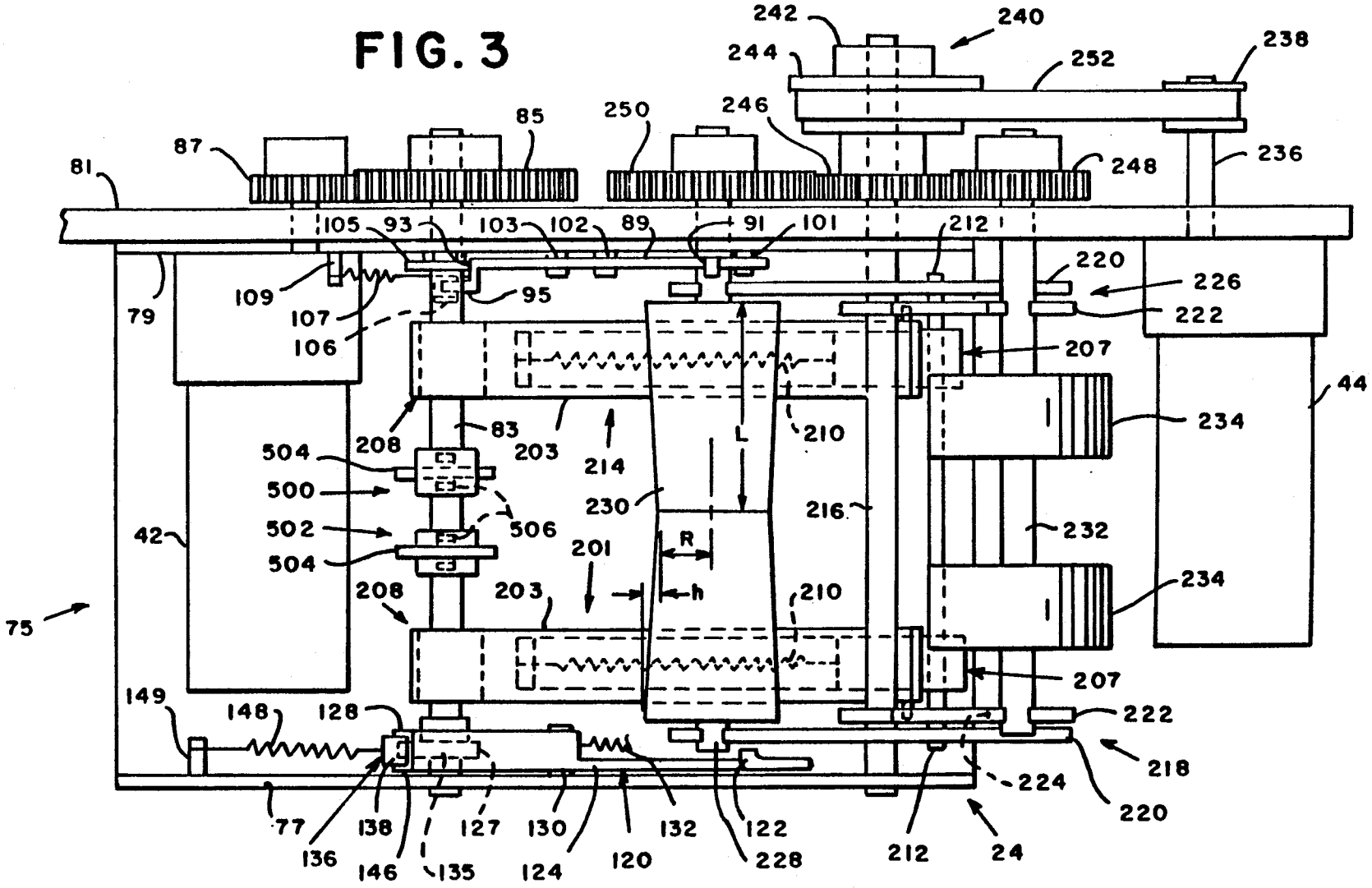
FIG. 3 is a sectioned top view of the thermal postage meter in accordance with the present invention.
Figure 4:
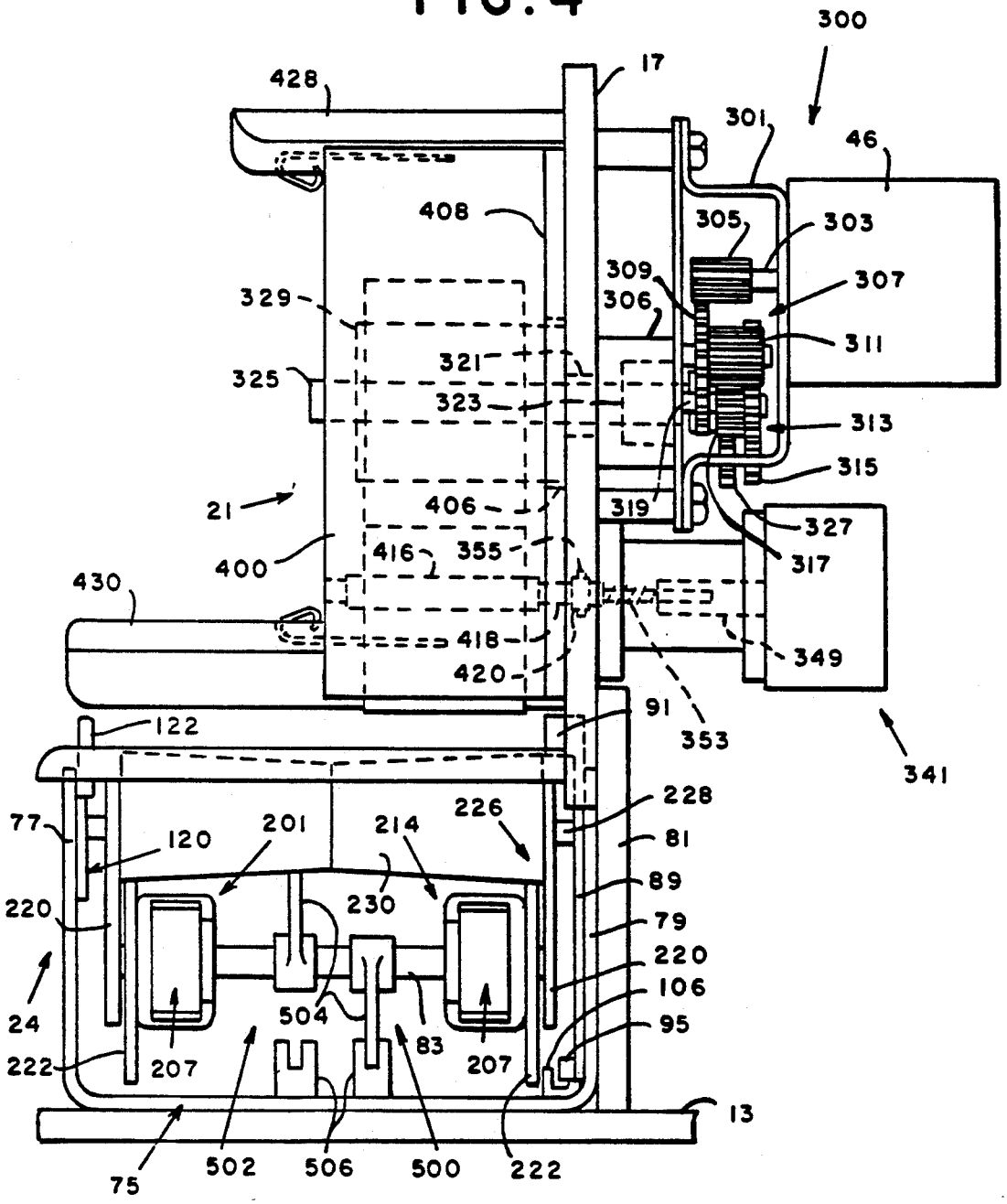
FIG. 4 is a sectioned end view of the thermal postage meter in accordance with the present invention.
Figure 5:
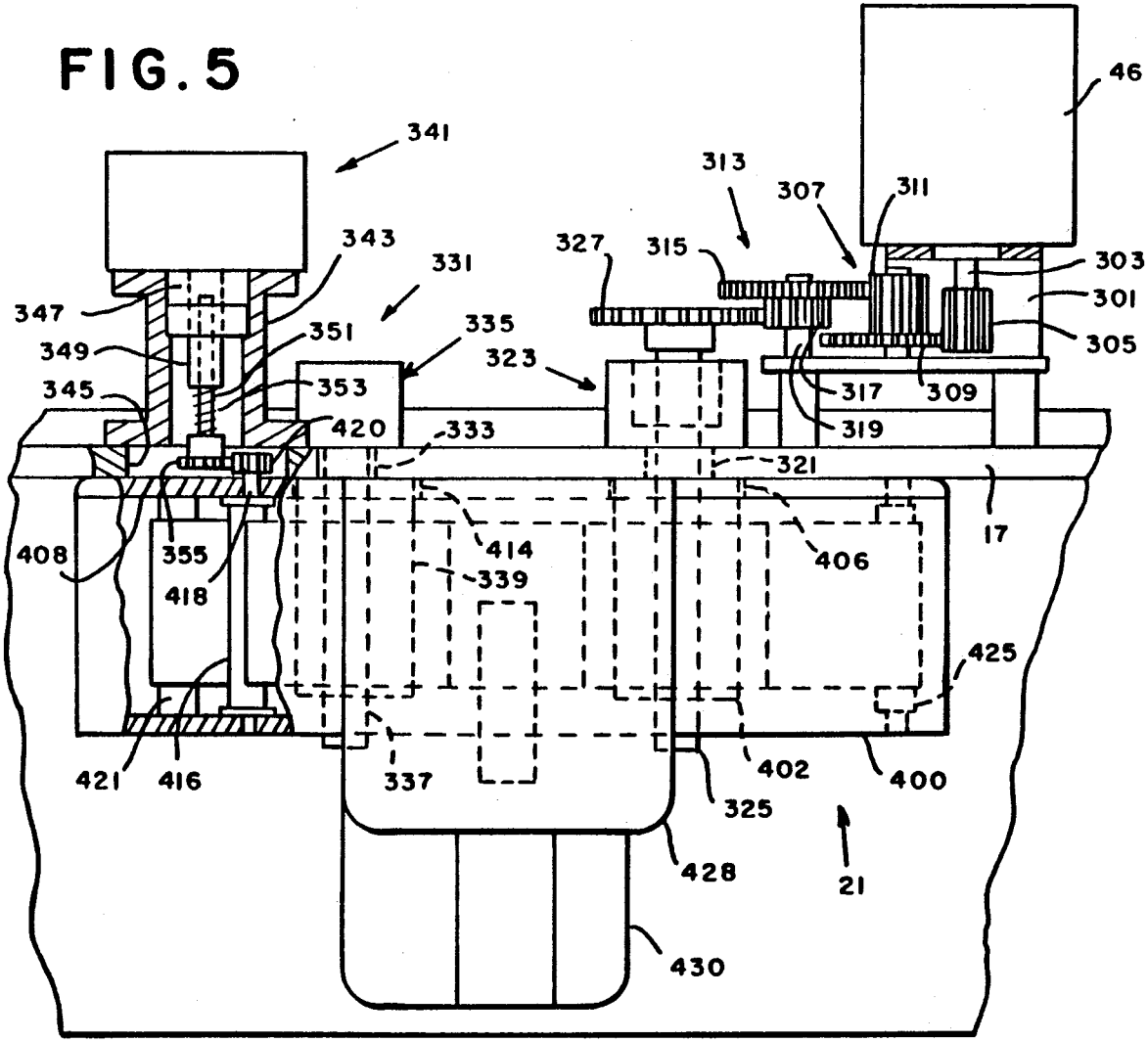
FIG. 5 is a top sectional view of the thermal postage meter in accordance with the resent invention.
Figure 6A:
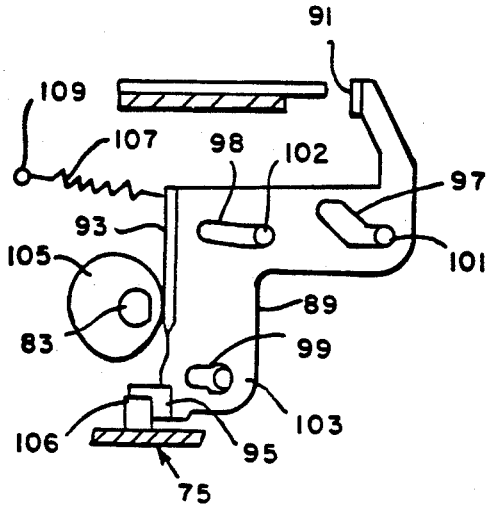
FIGS. 6A and 6B are side prospective views of a portion of a position sensing assembly indication, respectively, an initial and ducked position in accordance with the present invention.
Figure 6B:
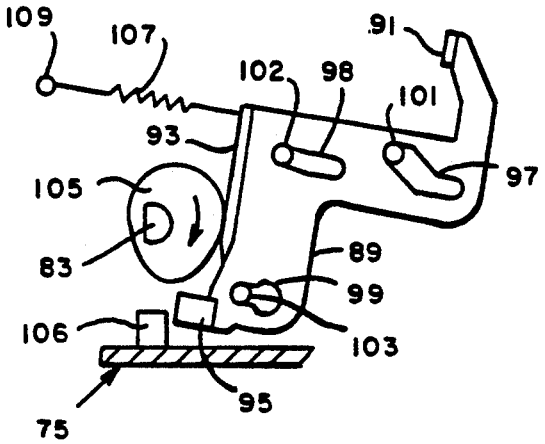
Figure 7A:
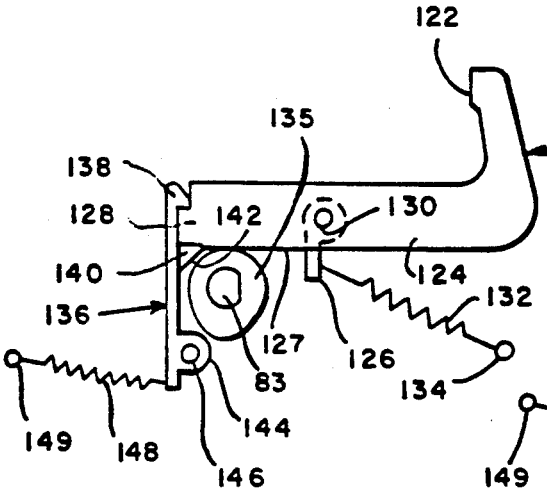
FIGS. 7A and 7B are side prospective views of a portion of a stop assembly indicating, respectively, an initial and a ducked position in accordance with the present invention.
Figure 7B:
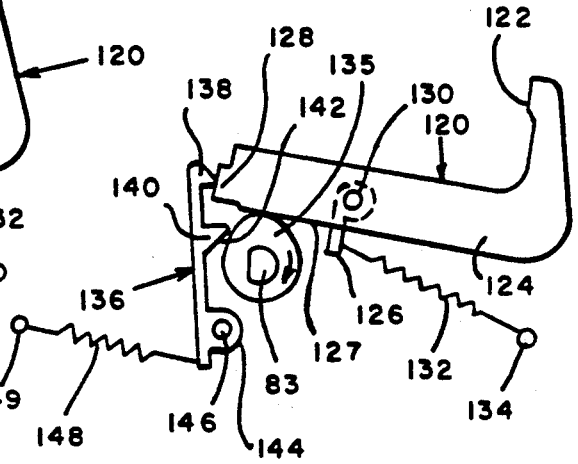
Figure 8A:
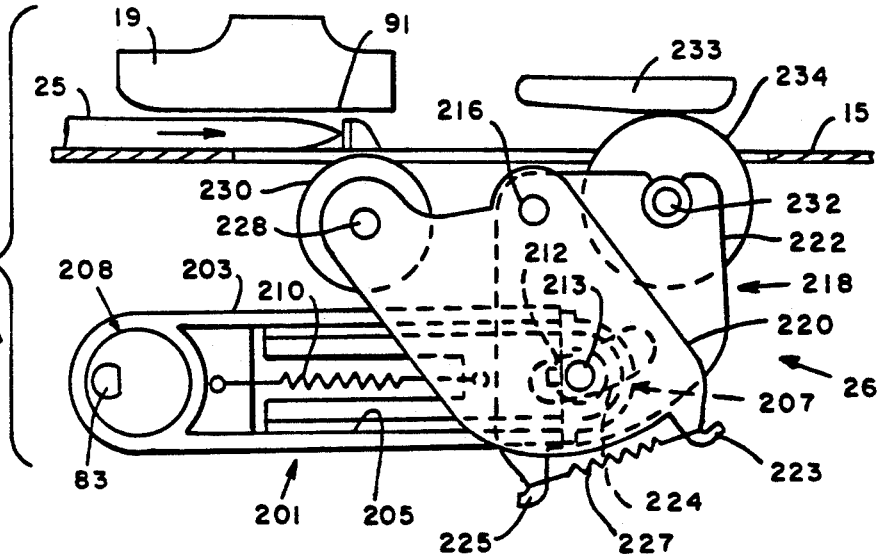
FIGS. 8A, 8B and 8C are schematic views of the platen and pressure roller assemblies in the home position, print position and eject position, respectively.

Referring to FIGS. 3, 4, and 8A, the platen roller assembly 26 includes a linking arm assembly 201 comprising a first link section 203 having a receiving channel 205 and a second section 207 having a portion matingly received in the receiving channel 205 of the first linking section 203. One end 208 of the first linking section 203 is eccentrically mounted around the shaft 83. A spring 210 having tis respective ends detachably mounted in the first and second sections of the linking arm 203 and 207, respectively, biases the second section 207 within the receiving channel 205 of the first link section 203. The exposed end of the second section 207 includes a hub 212. A second linking arm assembly 214 is constructed identical to the linking assembly 201 and is eccentrically mounted in cooperative alignment with the linking arm assembly 201 on the shaft 83.

A pivot link assembly, generally indicated as 218, is mounted to a shaft 216 which is rotatively mounted between the rearward and forward bracket walls 77 and 79, respectively. The pivot link assembly 218 includes a first link plate 220 pivotally mounted around shaft 216 at one point and pivotally mounted around the hub 212 at another point. A second link plate 222 is pivotally mounted around the shaft 216 at one point and includes a slot 224 wherein the hub 212 rides therein. A spring hook 223 is formed in the first link plate 220 and a spring hook 225 is formed in the second link plate 222. A spring 227 has its respective ends fastened around the respective spring hooks 223 and 225 in a conventional manner. A second pivot link assembly 226, identical to the pivot link assembly 218, is pivotally mounted to the shaft 216 in spaced apart relationship to the pivot link assembly 218. A platen roller shaft 228 is rotatively mounted by any conventional means to the link plates 220 of the respective pivot link assemblies, 218 and 226. A platen roller 230 is fixably mounted around the platen roller shaft 228, between the pivot link assemblies, 218 and 226.

A pressure roller shaft 232 is rotatively mounted by any conventional means to the link plates 222 of the respective pivot link assemblies 218 and 226. Pressure rollers 234 are fixably mounted around the pressure roller shaft 232 in spaced apart relationship. The pressure rollers 234 are aligned generally opposite an ejection plate 233 fixably mounted on the registration wall 17 and extending laterally therefrom. A drive shaft 236 having a spool 238 fixably mounted to one end is responsive to the motor 44. A spool gear arrangement 240 which includes a hub 242 rotatively mounted around the shaft 216, a spool 244 fixably mounted to the hub 242. A gear 246 is fixably mounted to shaft 216. A gear 248 is fixably mounted to the shaft 232 and a gear 250 is fixably mounted around the shaft 228. The gear 246 is constant mesh with gear 248 and 250, and an endless belt 252 extends around the spools 238 and 244.

Referring to FIGS. 1 and 4, a thermal drive cassette assembly, generally indicated as 300, is comprised of a mounting platform 301 of any suitable construction. The mounting platform 301 is fixably mounted, by any conventional means, to the back side of the registration wall 17. A tape motor 46 is fixably mounted to the mounting platform 301, by any suitable conventional means. The output shaft 303 of the drive motor 46 has a drive gear 305 fixably mounted to the output shaft 303 of the drive motor 46. A conventional double gear set 307 having a first gear 309 in constant mesh with the drive gear 305 and a second gear 311 rotatively mounted to the back side of the registration wall 17. A conventional double idle gear set 313 having first gear 315 in constant mesh with the gear 311 and a second gear 317 is rotatively mounted by any conventional means to a gear hub 319. The gear hub 319 is fixably mounted to the mounting platform 317 by any conventional means and rotatively supports the idle gear set 313 by any suitable conventional means. A registration wall aperture 312 is formed in the registration wall 17. A conventional bearing hub assembly 323 is fixably mounted to the back side of the registration wall 17 aligned to the aperture 321. A tape drive shaft 325 extends through the aperture 321 rotatively supported by the bearing hub assembly 323. A gear 327 is fixably mounted by any conventional means to one end of the tape drive shaft 325 in constant mesh with the gear 317. A tape drive spool 329 is fixably mounted by any conventional means around a portion of the tape drive shaft 325.

A tape idle assembly, generally indicated as 331, is mounted to the back side of the registration wall 17 aligned to a registration wall aperture 333. The tape idle assembly includes a convention one way clutch and shaft assembly of any suitable construction fixably mounted to the back side of the registration wall 17 aligned to the aperture 333. The assembly 335 includes an idle shaft 337 extending through the aperture 333. A tape idle spool 339 is fixably mounted by any conventional means around a portion of the idle shaft 337.

An encoding assembly, generally indicated as 341, is fixably mounted to a mounting spindle 343 which is fixably mounted to the back side of the registration wall 17, by any suitable conventional means, aligned to a registration wall aperture 345. The encoding assembly 341 includes collar 347 and a input shaft 349. A mating male shaft 351 is received by the shaft 349 such that the male shaft 351 can experience limited axially displacement within the shaft 349 and such that the male shaft rotatively drive the shaft 349 such as by any suitable conventional mating longitudinal gears arrangement. A spring 353 is placed around the shaft 351 and an end cap gear 355 is fixably mounted by any conventional means to the shaft 351 within the aperture 345.

The tape cassette 21 is comprised of a cassette housing 400 having a drive spool 402. The drive spool has formed axial extending gear teeth 404. The drive spool 402 is rotatively mounted by suitable conventional means in the cassette housing 400 to be axially aligned to a opening 406 in the rear wall 408 of the housing 400. The gear teeth 404 of the drive spool 402 are configured to be mating to axial gear teeth 330 formed on the periphery of the tape drive spool 329. In like manner to drive spool 402, the cassette housing includes idle spool 339 having axial extending gear teeth 340 rotatively mounted to the rear wall 408 aligned to an opening 414 in the rear wall 408. The gear teeth 412 are configured to be mating to axial gear teeth 412 formed on the periphery of the tape idle spool 410. An encoding roller 416 is rotatively mounted in the cassette rear wall 408, by any suitable conventional means, having a short shaft 418 extending through the rear wall 408 and into the aperture 345 in the registration wall 17. A gear 420 is fixably mounted to one end of the short shaft 418 to be in constant mesh with the gear 355 of the encoding assembly 341. A plurality drag post 421, 422, 423, 424 and 425 are strategically mounted fixably by any conventional means to the cassette rear wall 408. The cassette housing 400 further has a cassette opening 426 and is mounted between upper clamp 428 and lower clamp 430 which extend from the registration wall 17.

Referring to FIG. 3, the platen roller 230 has a length 2L and a radius of R at the center. The radius of the platen roller 230 has a linear surface transition to a end radius of (R+h). In the preferred embodiment of the present invention, the platen roller is comprised of a 25 to 35 durometer cellular urethane. The preferred dimensions.

| | |
|---|---|
| Length (2L) | 3.000 inches |

-continued

| | |
|---|---|
| Center Radius (R) | 0.4245 inches |
| End Radius (R + h) | 0.4845 inches |
| Taper Angle | 2.3 degrees |

Referring to FIGS. 1, 3, and 8A, 8B and 8C, the function of the thermal postage meter 11 is to accept an envelope 25, print an indicia using thermal transfer print technology, and eject the envelope 25 from the meter 11. The feed direction of the meter 11 is from left to right as viewed in FIG. 1. The platen roller 230 feeds the envelope 25 at a constant rate and supplies the print head 19 sufficient backing pressure needed for transfer of thermal ink from the ribbon to the envelope 25 during the print cycle. The microcontroller 30 is programmed to instruct the print controller 38 to actuate the heating elements of the print head 19 synchronous to displacement of the envelope 25 to produce a postal image or other desired image.

As the platen roller 230 feeds the envelope 25, it also feeds the thermal transfer ribbon. Therefore, use of the platen roller 230 for ejection would lead to wasted ribbon. The ejection rollers 234 are used to feed the envelope out of the meter 11 after printing.

As previously described, the thermal transfer ribbon feeds around a urethane wrapped encoder roller 416 inside the cassette 21. As the ribbon feeds, the friction of the ribbon against the encoder roller 416 causes it to turn. The encoder roller 416 has a gear 420 which protrudes from the back side of the cassette and couples with a mating gear 355 in the meter 11. The mating gear 355 turns an optical encoder 341 which communicates with the microcontroller 30 for monitoring ribbon motion.

Figure 8B:
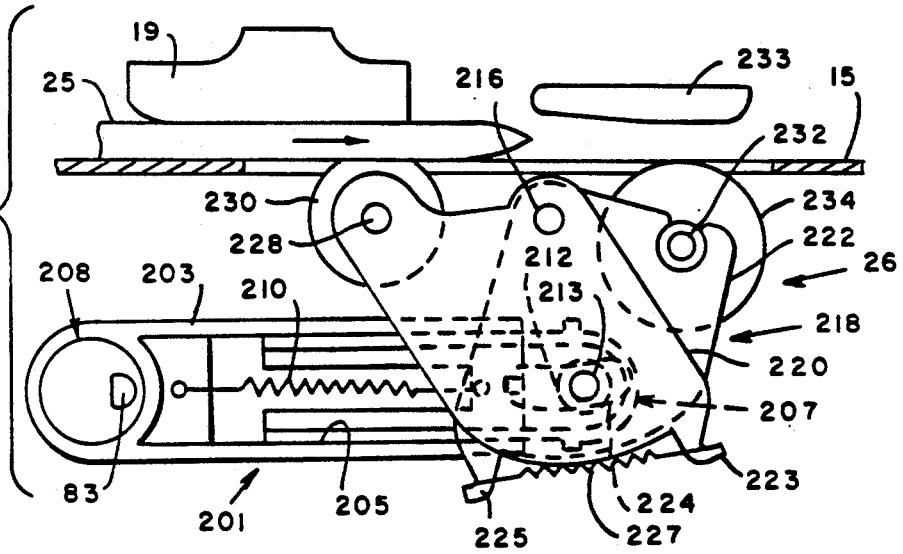
Figure 8C:
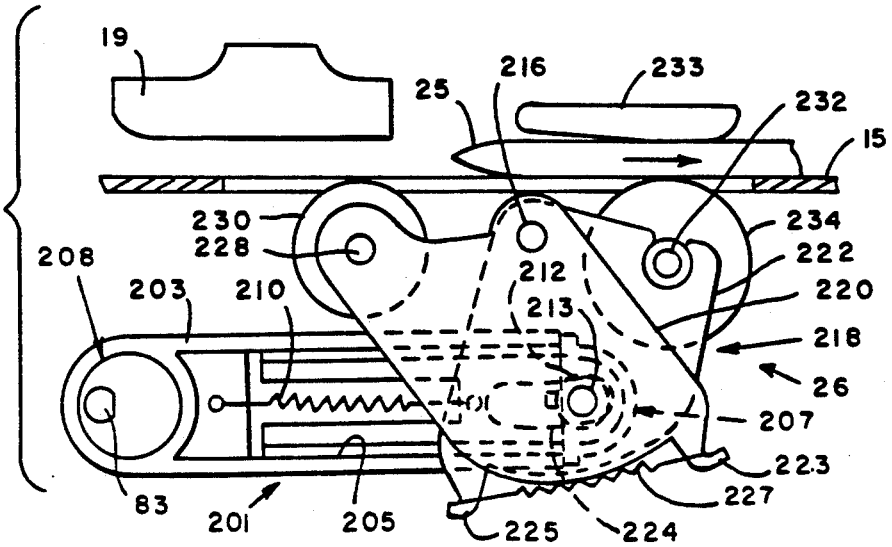

Referring particularly to FIGS. 8A, 8B and 8C, the feed system consists of the platen roller 230 and ejection rollers 234. These rollers are provided with independent control of the envelope 25. They are mounted on a linking assembly 218 and 226 in a manner to produce a rocker type action which pivots about a fixed location, shaft 216. In the home position (FIG. 8A), the pressure rollers 234 are above the feed deck 15 and the platen roller 230 is below the feed deck. The envelope stop lever 120 and envelope position lever 89 are above the feed deck in the path of the envelope 25. The shaft 83 is positioned at 0 degrees rotation. It should be readily apparent that the deck 15 is provided with suitable located openings to accommodate the motion of the platen roller 230, pressure rollers 234, position lever 89 and stop lever 120.

An envelope 25 is placed onto the feed deck 15 by the operator and inserted into the feed throat. The envelope 25 hits the spring loaded position lever 89 and stop lever 120 which is retained by a locking lever 136. The purpose of the stop finger 120 is to keep the envelope 25 from feeding too far through the print path and also to assure proper alignment of the envelope 25. The position lever 89 is displaced by the envelope 25 and actuates the sensor 106 mounted to the base 24 in response to the displacement of sensor tab 95. In response to actuation of the sensor 106, the microcontroller 30 begins the print cycle. When the rip position lever 89 is pushed forward about 4 mm, it unblocks an optical sensor 106. The microcontroller signals the motor 42 to rotate shaft 83 in a clockwise direction. The cam shaft 83 contains 2 independent cams 135 and 105 which drive the stop lever 120 and the position lever 89, respectively, out of the feed path. The stop lever cam 135 first rotates the lock lever 138 out of the way. The shaft 83 then continues rotating to move the spring loaded stop lever 120 out of the feed path. The position lever cam 105 directly drives the position lever 89 from the path. The stop lever 120 and position lever 89 are completely out of the paper path after 180 degrees of shaft 83 rotation.

Concurrently with disengagement of levers 89 and 120, the eccentric shaft 83 rotation causes the spring loaded links 203 and 207 to move the pressure rollers 234 out of the feed path and the platen roller 230 toward the envelope 25. The platen roller 230 continues moving toward the envelope 25 until it closes the envelope 25 between the platen roller 230 and the print head 19 capturing the thermal ribbon therebetween. Depending on the envelope 25 thickness, the platen roller 230 will meet the envelope 25 at different points in the rotation on the shaft 83. The pressure rollers 234 may still be above the feed deck. The shaft 83 will then continue to rotate, causing the links 203 and 207 to separate further and both the link extension springs 210 and the ejection springs 227 to apply a load to the envelope 25. When the shaft 83 has rotated 180 degrees, the pressure rollers 234 are out of the feed path and the platen roller 30 is fully engaged with the envelope. Printing can not begin.

As mentioned, the shaft 83 acts on and 208, the stop cam 127, the trip finger cam 105 and a set of flags 504. The flags 504 trigger the microcontroller 30 when the shaft 83 has rotated 180 degrees. In the most preferred embodiment, the shaft 83 is driven by a DC brush-type gear motor 42 via a set of gears. When the flag 504 signals the microcontroller 30 that it is time to stop the shaft 83 rotation, the motor 42 is electronically braked.

Once the platen roller 230 has fully engaged the envelope 25, the drive motor 44 and the ribbon drive motor 46 start under the direction of the microcontroller 30. It is noted that the motor 44 turns both the platen roller 230 and the pressure rollers 234. However, the pressure rollers is not in the supply path so it has no affect on the envelope 25. Upon initiation of the print cycle, the envelope 25 and ribbon begins to feed as the motor 44 is brought up to speed. Printing then starts by loading data to the print head from the print head controller 38 under the command instruction of the microcontroller 30 at a constant rate. The speed is monitored and controlled through the conventional motor encoder (not shown) on the motor 44. In the most preferred embodiment of the present invention, the printing operation takes about 425 ms.

While printing, the ribbon is driven through the print nip by the motion of the envelope 25. The ribbon take-up motor 46 winds up the ribbon on the take-up core and provides even tension without pulling the ribbon through the print EMP of the motor 46 is monitored in the preferred embodiment. Changes in the back EMF indicate quantity of ribbon and the ribbon drive is modified accordingly by the microcontroller 30. In addition, a sharp change in the back EMF of the motor indicates that the ribbon is broken after the print hear or the ribbon has stopped, in either case, the microcontroller 30 aborts.

While printing, the ribbon is driven through the print be maintained. The ribbon is fed through a roller 416 and post 421 which provide drag to the ribbon through the friction of the ribbon against the roller 416 and post 421. A light clutch load is provided by conventional clutch 335 on the ribbon supply core to provide tighter wrap of the ribbon around the roller 416 and post 421. The ribbon encoder 341 is turned by the friction of the ribbon moving past the roller 416. The decoder motion 341 is monitored by the microcontroller 30 to determine if the ribbon breaks before reaching the print head or if the ribbon runs out, in which case, the microcontroller will abort. In addition, the encoder 341 can be used to monitor the speed of the ribbon, and therefore the envelope 25, through the print nip.

When printing has been competed, the shaft 83 rotates an additional 180 degrees back to its original home position. The linking arm assembly 201 becomes a solid assembly which pushes the pressure rollers 234 against the envelope 25. Since a lighter load is needed for ejection than for printing, the spring 210 becomes the only active spring. Again, flags 504 on the shaft 83 interrupt a optical sensor 506 to indicate 180 degrees of rotation. This 180 degree rotation engages the pressure rollers 234 and disengages the platen roller 230. During the rotation, the stop lever 120 and position lever 89 are also released to extend above the feed deck. Due to their very light spring load, the levers 89 and 120 will ride along the bottom of the envelope 25 until it clears the platen roller 230.

The motor 44 continues to drive rollers 230 and 234. At this point, however, the platen roller 230 becomes inactive because it is below the feed deck. At the same time, the ribbon motor 46 is stopped. When the pressure rollers 234 engage they feed the envelope 25 from the printer at 2 to 3 times the print speed in the preferred embodiment. Once the envelope 25 clears the print nip, the stop lever and position lever, 120 and 89, respectively, return to their home position. The drive motor 44 is stopped and the process is complete.

The above description described the preferred embodiment of the invention and should not be viewed as limiting. The scope of the invention is set forth in the appendix claims.

What is claimed is:

1. A thermal printing postage meter having a base supporting a registration wall and a deck, and a thermal print head fixably mounted to said registration wall above a portion of said deck to defining a print station for printing a postage indicia on an envelope having a leading edge positioned on said deck in said print station, comprising:

a position sensing means for sensing the presence of said envelope's leading edge in said print station;

a microcontroller in bus communication with said position sensing means;

a thermal tape cassette having an opening a thermal ribbon, said thermal tape cassette detachably mounted to said registration wall such that said thermal print head extends through said opening and having said thermal ribbon passing below said thermal print head;

a platen roller assembly having a platen roller and a positioning means responsive to instruction from said microcontroller for causing said platen roller to assume a second position biasing said envelope against said thermal ribbon and said thermal print head, and a home position ducked below said deck;

an ejection plate fixably mounted to said registration wall;

an ejection roller assembly having a pressure roller and a positioning means responsive to instruction from said microcontroller for causing said pressure roller to assume a home position biasing said ejection roller assembly towards said ejection plate and a second position ducked below said deck;

motor means in bus communication with and responsive to said microcontroller for causing said platen roller and said pressure roller to rotate under the control of said microcontroller;

said microcontroller being programmed such that in response to activation of said position sensing means by said envelope, said microcontroller to cause said platen roller assembly to assume said second position and said ejection roller assembly to assume said second position and to initiate a print sequence instruction to said print head while synchronously causing said motor means to cause said platen roller to rotate at a first speed, following completion of said print sequence, said microcontroller to cause said platen roller assembly to assume said home position and said pressure roller assembly to assume said home position and causing said ejection roller to rotate at a second speed.

2. A thermal printing postage meter as claimed in claim 1 further comprising stop means for preventing said envelope from being mis-positioned longitudinally on said deck.

* * * * *